US006382002B1

(12) United States Patent
Chen

(10) Patent No.: US 6,382,002 B1
(45) Date of Patent: May 7, 2002

(54) GUN LOCK

(76) Inventor: Chang-Yu Chen, No. 47, Chu-Nan Rd., Feng-Tien Tsun, Nan-Pu Hsiang, Pingtung Hsien (TW)

( * ) Notice: Subject to any disclaimer, the term of this patent is extended or adjusted under 35 U.S.C. 154(b) by 9 days.

(21) Appl. No.: 09/589,178

(22) Filed: Jun. 2, 2000

(51) Int. Cl.[7] ..... F41A 17/02

(52) U.S. Cl. ..... 70/202; 70/202; 70/203; 42/70.06; 42/70.07; 42/70.11

(58) Field of Search ..... 70/202, 203, 18, 70/58, 49, 38 C; 42/70.07, 70.06, 70.11, 70.04

(56) References Cited

U.S. PATENT DOCUMENTS 4,509,281 A * 4/1985 Dreiling et al. ..... 42/70.07
5,153,360 A * 10/1992 Upton ..... 42/70.11
5,647,158 A * 7/1997 Eskelinen et al. ..... 42/70.07
5,737,864 A * 4/1998 Otto ..... 42/70.11

* cited by examiner

*Primary Examiner*—William A. Cuchlinski, Jr.
*Assistant Examiner*—Marthe Y. Marc-Coleman
(74) *Attorney, Agent, or Firm*—Jackson Walker L.L.P.

(57) ABSTRACT

A gun lock includes a key operated lock mounted on a gun to prevent said gun from firing. A faceplate is attached to one side of the key operated lock to abut the gun, and a spindle hole is defined in the other side of the key operated lock. A U-shaped latch bolt has two arms connected by a rigid connecting block. One arm of the latch bolt is inserted into the barrel of the gun to prevent a bullet from being moved into the chamber of the gun. The other arm of the latch bolt penetrates the spindle hole and is held in place by the key operated lock.

4 Claims, 5 Drawing Sheets

GUN LOCK

BACKGROUND OF THE INVENTION

1. Field of the Invention

The present invention relates to a lock, and more particularly to a gun lock that can prevent a gun from being discharged accidentally.

2. Description of Related Art

A gun is regarded as a lawful self-defense weapon in many countries. People can apply for a license to own a gun for self-defense in a lawful way. A gun sometimes can protect you from being held up or any other situations in which you may be hurt. Even though acquiring a gun is simple in many countries, how to use it safely is a serious problem because guns are lethal weapons. Two unfortunate situations are frequently seen.

1. Some teenagers steal guns from their parents to show off to his contemporaries or even to fight. Many children lose their lives like this every year.

2. Some people just collect guns. However, accidental discharge of a loaded gun is always a possibility when the gun is being handled or cleaned.

The present invention has arisen to mitigate and/or obviate the disadvantages.

SUMMARY OF THE INVENTION

In accordance with one aspect of the present invention, a gun lock includes a key operated lock mounted in the trigger guard of a gun to prevent the gun from discharging, and a metal rod is inserted in the barrel of the gun to prevent the bullet from moving into the chamber. The key operated lock and the metal rod are connected by a cable and a connecting block. The free end of the cable forms multiple ratchets that can be inserted into the key operated lock to hold the gun lock in place.

Further benefits and advantages of the present invention will become apparent after a careful reading of the detailed description with appropriate reference to the accompanying drawings.

DETAILED DESCRIPTION OF THE INVENTION

Figure 1:
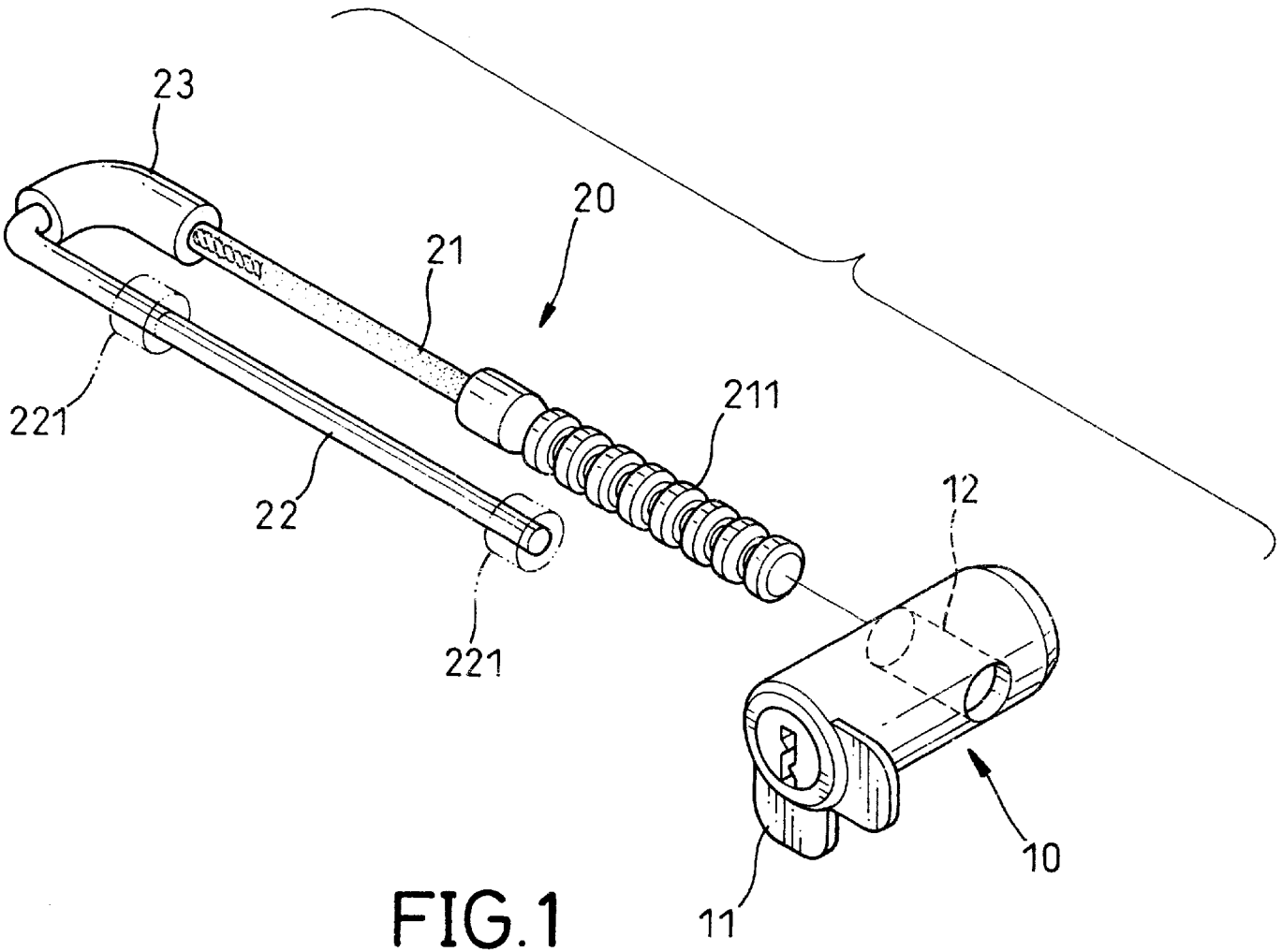
FIG. 1 is an exploded perspective view of a gun lock in accordance with the present invention.

Referring to the drawings and initially to FIG. 1, a gun lock in accordance with the present invention comprises a key operated lock (10) and a latch bolt (20) mounted in the key operated lock (10).

The key operated lock (10) includes at least one faceplate (11) attached to one end and a spindle hole (12) with a ratchet (not shown) defined in the other end. The key operated lock (10), as shown in FIG. 1 and FIG. 4, includes two faceplates (11) wherein one of the faceplate (11) extends toward the butt and the other extends opposite to the barrel.

The latch bolt (20) includes a first arm (21), a second arm (22) and a rigid connecting block (23). The first arm (21) and the second arm (22) are connected by the connecting block (23) to form a U-shape. The second arm (22) is a metal rod inserted into the barrel of the gun and abuts the firing pin to prevent a bullet from moving into the chamber of the gun. At least one cushion (221) is mounted around the second (22) of the latch bolt (20) to prevent the periphery of the barrel from being scraped due to the metal rod. The first arm (21) is flexible and has multiple ratchets (211) attached to the free end. The ratchets (211) are received and clamped in the spindle hole (12) to prevent the metal rod (22) from detaching from the barrel of the gun. The ratchets (211) can not detach from the spindle hole (12) of the key operated lock (10) unless the key is used to release the lock (10).

Figure 4:
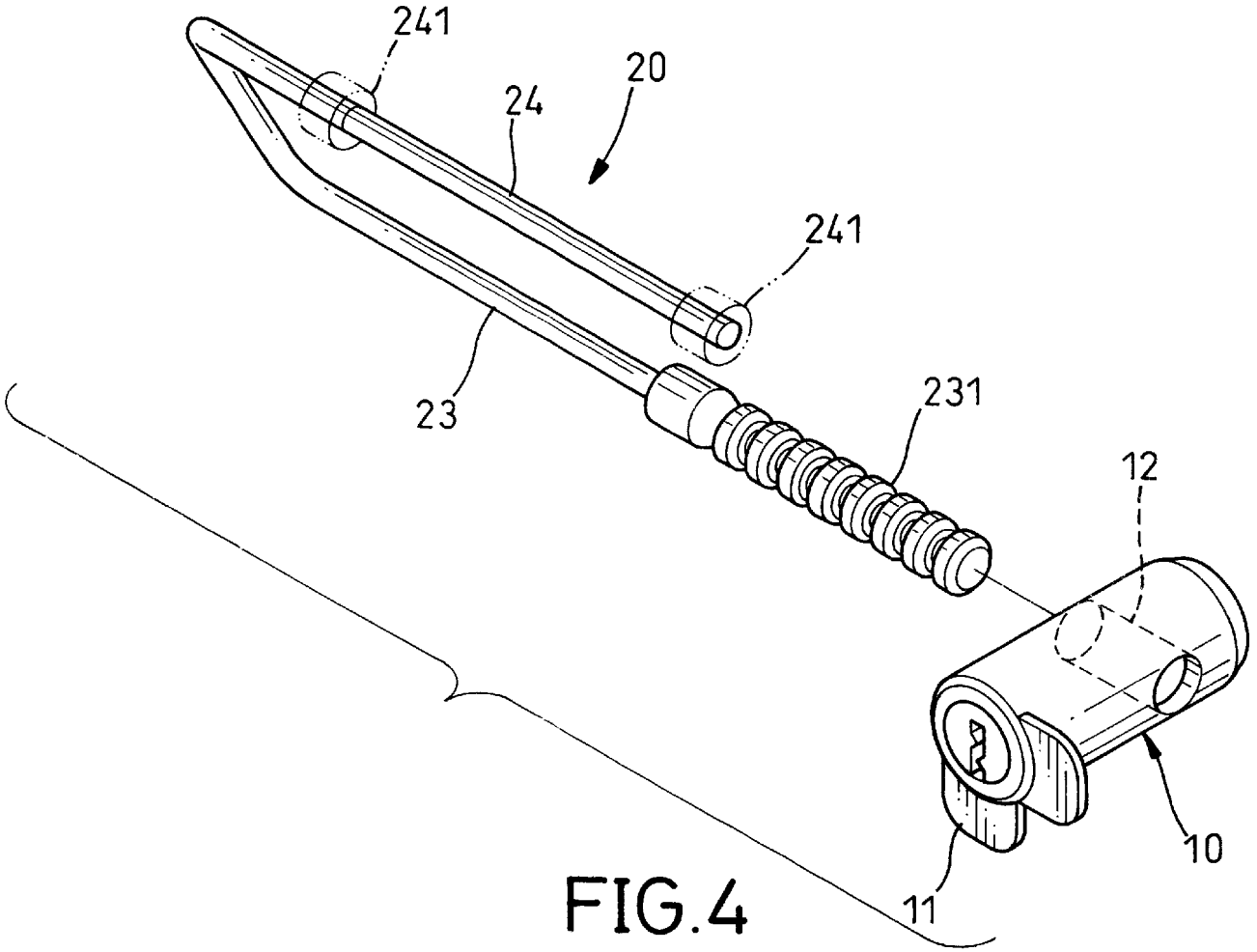
FIG. 4 is an exploded perspective view of second embodiment of the gun lock in accordance with the present invention.

With reference to FIG. 4, the latch bolt (20) is a U-shaped metal rod and includes a first arm (23) and a second arm (24). The second arm (24) is inserted into the barrel of the gun and abutting the firing pin to prevent a bullet from moving into the chamber of the gun. At least one cushion (241) is mounted around the second (24) of the latch bolt (20) to prevent the periphery of the barrel from being scraped due to the metal rod. The first arm (23) has multiple ratchets (231) attached to the free end thereof. The ratchets (231) are received and clamped in the spindle hole (12) to prevent the latch bolt (20) from detaching from the barrel of the gun.

Figure 2:
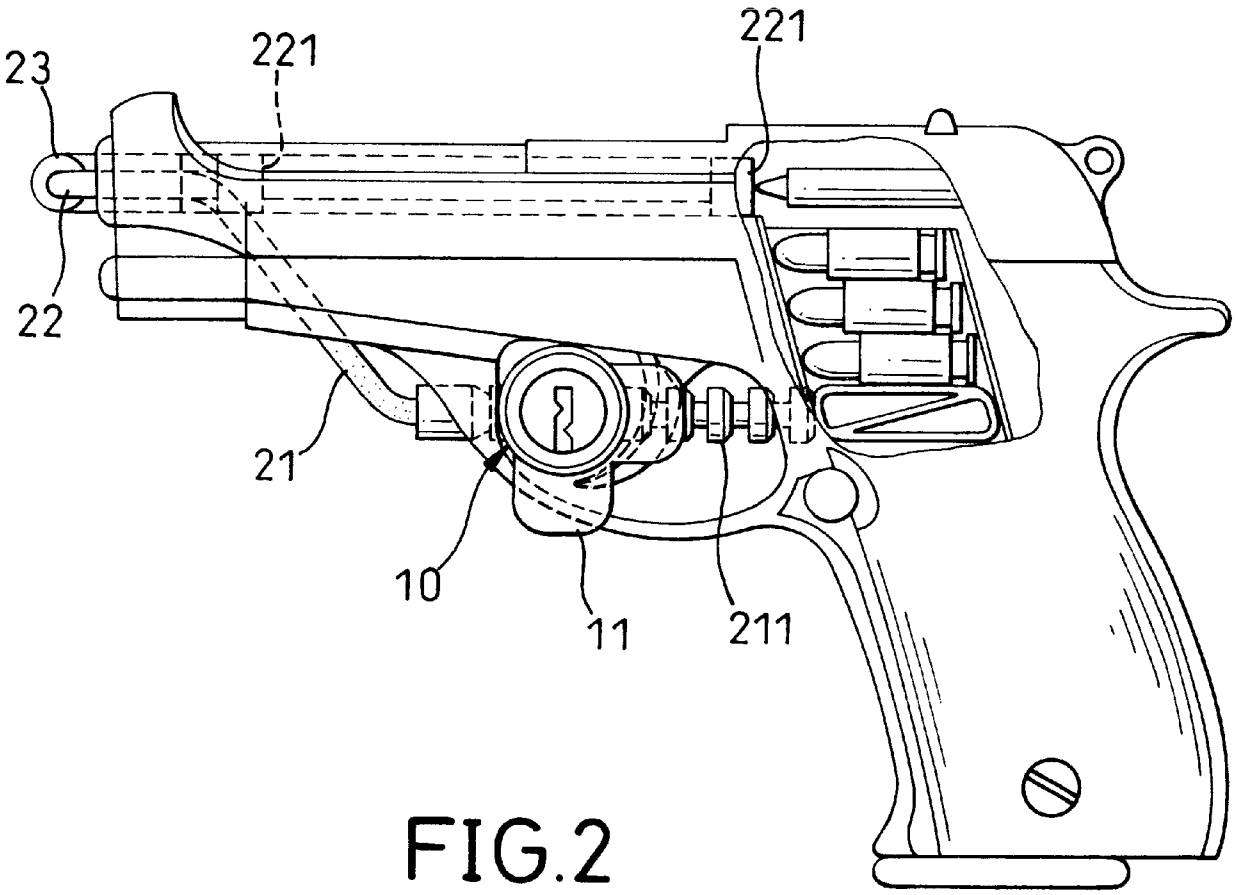
FIG. 2 is a side plan view of the gun lock in FIG. 1 mounted on a gun.
Figure 3:
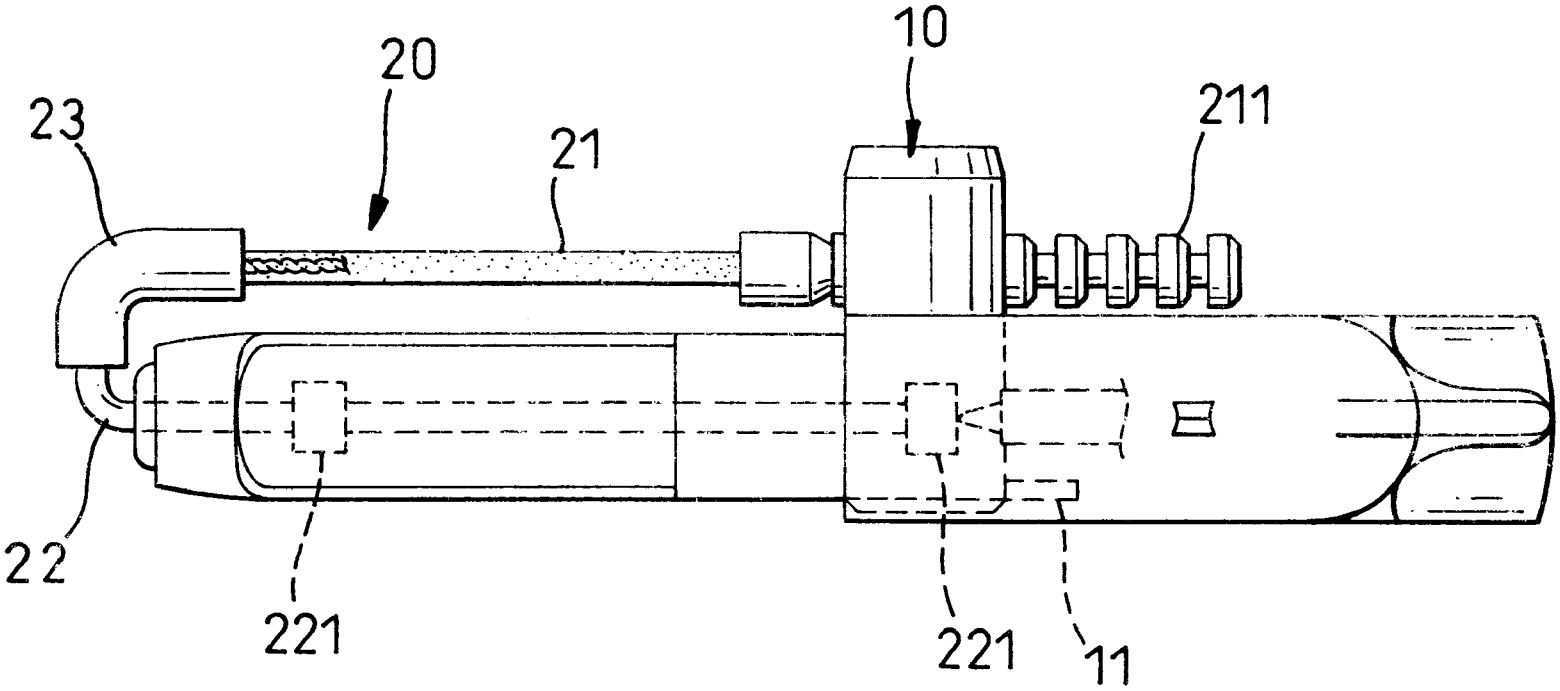
FIG. 3 is a top plan view of the gun lock in FIG. 1 mounted on a gun.
Figure 5:
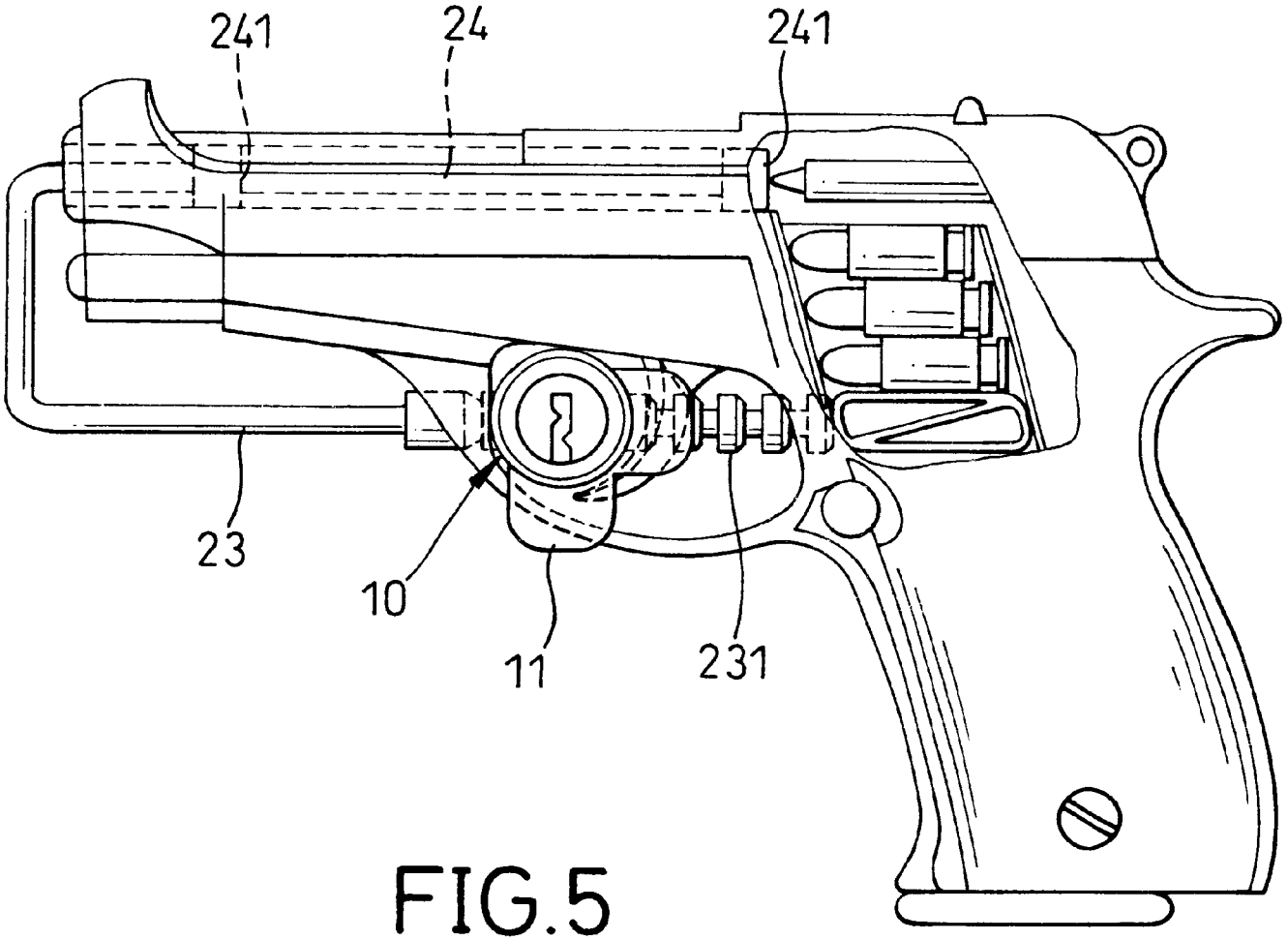
FIG. 5 is a side plan view of the gun lock in FIG. 4 mounted on a gun.

With reference to FIGS. 2, 3 and 5, the gun lock is mounted on a gun. The key operated lock (10) extends through the gun between the trigger and the trigger guard to prevent the gun from being fired. The metal rod (22) is inserted into the barrel and abuts the firing pin to prevent a bullet from moving into the chamber. The metal rod (22) is held in place by the ratchet stop (211) received and clamped in the spindle hole (12) of the key operated lock (10). The length of the cable (21) and the metal rod (22) can be changed to accommodate different guns. For the foregoing reasons, the gun lock in accordance with the present invention is a safe design that will prevent the gun from discharging accidentally and prevent the gun from being used by children or other unauthorized people.

Although the invention has been explained in relation to its preferred embodiment, it is to be understood that many other possible modifications and variations can be made without departing from the spirit and scope of the invention as hereinafter claimed.

What is claimed is:

1. A gun lock comprising:

a key operated lock mounted on a gun to prevent said gun from being fired;

at least one faceplate attached to a first side of said key operated lock and a spindle hole defined in a second side of said key operated lock;

a U-shaped latch bolt held in place by said key operated lock, including a first arm including multiple ratchets attached to a free end thereof, said first arm extending through said spindle hole of said key operated lock and said free end being fastenable inside said spindle hole and a second arm inserted into a barrel and abutting a firing pin of a gun.

2. The gun lock as claimed in claim 1, wherein said first arm of said latch bolt is a flexible cable locked and extending through said spindle hole, and said second arm is a metal rod inserted into said barrel.

3. The gun lock as claimed in claim 1, wherein said first arm of said latch bolt is a metal rod locked and extending through said spindle hole, and the second arm is a metal rod inserted into said barrel.

4. The gun lock as claimed in claim 1, wherein said second arm of the latch bolt has at least one cushion mounted around said second arm to prevent a periphery of said barrel from being scraped.

* * * * *